US005906010A

United States Patent [19]

Suzuki

[11] Patent Number: 5,906,010

[45] Date of Patent: May 25, 1999

[54] OPERATING HINGE FOR SEAT AND SEAT LID OF TOILET BOWL

[75] Inventor: Naokazu Suzuki, Kanagawa, Japan

[73] Assignee: Katoh Electrical Machinery Co., Ltd., Kanagawa, Japan

[21] Appl. No.: 09/038,434

[22] Filed: Mar. 11, 1998

[30] Foreign Application Priority Data

Mar. 14, 1997 [JP] Japan ..... 9-061234

[51] Int. Cl.[6] ..... A47K 13/12

[52] U.S. Cl. ..... 4/236; 4/248; 188/268; 16/342

[58] Field of Search ..... 4/236, 240, 246.1, 4/248; 16/86 R, 342; 188/268

[56] References Cited

U.S. PATENT DOCUMENTS

| | | | |
|---|---|---|---|
| 4,428,094 | 1/1984 | Emain | 16/342 X |
| 4,639,147 | 1/1987 | Schwarz | 4/236 X |
| 4,982,453 | 1/1991 | Matsumoto | 4/248 |
| 5,542,508 | 8/1996 | Van Erden et al. | 188/268 |

FOREIGN PATENT DOCUMENTS

| | | | |
|---|---|---|---|
| 3722114 | 1/1988 | Germany | 4/248 |
| 3718705 | 12/1988 | Germany | 4/248 |

*Primary Examiner*—Robert M. Fetsuga
*Attorney, Agent, or Firm*—Notaro & Michalos P.C.

[57] ABSTRACT

An operating hinge for a seat and seat lid of a toilet bowl, simply constructed and capable of controlling the angular moment of the seat and lid to softly stop them in place at their respective predetermined ends of pivoting stroke, provided. The operating hinge comprises a hinge case to be installed to a body of a toilet bowl, a shaft provided rotatably inside the hinge case to support the seat and seat lid, a stationary cam secured inside the hinge case and having formed therein a central hole through which the rotating shaft is axially penetrated, a cam provided inside the hinge case in a vis-vis relationship with the stationary cam and having formed therein a central hole through which the rotating shaft is axially penetrated, to be slidable on, and rotatable with, the rotating shaft, and a resilient member for urging the rotatable sliding cam toward the stationary cam, further comprising, to more positively control the rotation of the rotating shaft, a rubber ring fitted on the rotating shaft to abut the inner wall of the hinge case, a viscous oil applied between the periphery of the rubber ring and the hinge case inner wall the rubber ring abuts, and a screw for adjusting a pressure the rubber ring applies to the inner wall of the hinge case.

4 Claims, 10 Drawing Sheets

OPERATING HINGE FOR SEAT AND SEAT LID OF TOILET BOWL

BACKGROUND OF THE INVENTION

1. Field of the Invention

The present invention relates to a toilet bowl, and more particularly, to a hinge suitably usable for opening and closing a seat and seat lid of a toilet bowl.

2. Description of the Prior Art

Various types of hinges for opening and closing, or operating, a seat and seat lid of a toilet bowl have been proposed so far. Typical ones of such hinges include a combination of a shaft rotatable as the toilet seat and lid are pivoted for opening or closing, with a cam mechanism incorporating a compression spring and which acts on the shaft, a combination of a rotating shaft and a torsion spring which acts to cancel a torque of the shaft being rotated in a predetermined direction, a combination of a rotating shaft and a rotation damper, etc.

The combination of a rotating shaft with only a cam mechanism incorporating a compression spring and which acts on the shaft is advantageous in that a matching can easily be attained between a torque generated when the seat and lid is operated and an angular moment of the seat and lid. For a large rotating torque, however, the entire structure should be designed larger.

The combination of a rotating shaft with only a torsion spring which acts on the shaft has an advantage in that a small structure can create a large rotating torque. Since it creates a rotating torque which will increase and decrease linearly, however, no easy matching is possible between the rotating torque and an angular moment of the seat and lid which will depict a sine curve, and it is difficult to elaborately fit the movement of the seat and lid as necessary to the rotating torque and also to appropriately control the movement of the seat and lid in each of the operating steps.

Further, the combination of a rotating shaft with only a rotation damper has an disadvantage that it is difficult to elaborately fit the movement of the seat and lid as necessary to the rotating torque and to appropriately control the movement of the seat and lid in each of the operating steps and that the seat and lid being opened or closed cannot easily be halted in an intermediate angular position and braked at a predetermined angular position the seat and lid have reached during each of the operating strokes, for example.

SUMMARY OF THE PRESENT INVENTION

Accordingly, the present invention has an object to overcome the above-mentioned drawbacks of the prior art by providing an operating hinge for a seat and seat lid of a toilet bowl, which is simply constructed and capable of controlling the angular moment of the seat and lid to softly stop them in place at their respective predetermined ends of opening and closing strokes.

The above object is accomplished by providing an operating hinge for a seat and seat lid of a toilet bowl including a hinge case to be installed to a body of a toilet bowl, a shaft provided rotatably inside the hinge case to support the seat and seat lid, a stationary cam secured inside the hinge case and having formed therein a central hole through which the rotating shaft is axially penetrated, a cam provided inside the hinge case in a vis-vis relationship with the stationary cam and having formed therein a central hole through which the rotating shaft is axially penetrated, to be slidable on, and rotatable with, the rotating shaft, and a resilient member for urging the rotatable sliding cam toward the stationary cam, further comprising, to more positively control the rotation of the rotating shaft, according to the present invention, a rubber ring fitted on the rotating shaft to abut the inner wall of the hinge case, a viscous oil applied between the periphery of the rubber ring and the hinge case inner wall the rubber ring abuts, and a means of adjusting a pressure the rubber ring applies to the inner wall of the hinge case.

The means of adjusting the pressure applied by the rubber ring may comprise a flanged collar fitted on, and rotatably with, a small-diameter portion of the rotating shaft penetrated through a partition wall formed integrally in the hinge case, a rubber ring fitted axially slidably on the periphery of the collar, a compression ring fitted on the periphery of the collar to abut the rubber ring, a washer and a screw urging the compression ring axially.

Also, a recess may be formed on the outer periphery of the rubber ring to receive and retain the viscous oil therein.

BRIEF DESCRIPTION OF THE DRAWINGS

In order that the invention may be clearly understood and readily carried into effect, some embodiments thereof, in which the present invention is applied for operating a seat and seat lid of a toilet bowl, will now be described, by way of example only, with reference to the accompanying drawings, of which.

DETAILED DESCRIPTION OF THE PREFERRED EMBODIMENTS

A description of the present invention will be made hereinafter of an embodiment in which the present invention is applied for operating, or opening and closing, a seat and seat lid of a toilet bowl. It should be noted, however, that the present invention is not limited to such an embodiment only and it is applicable for various opening and closing structures.

Figure 1:
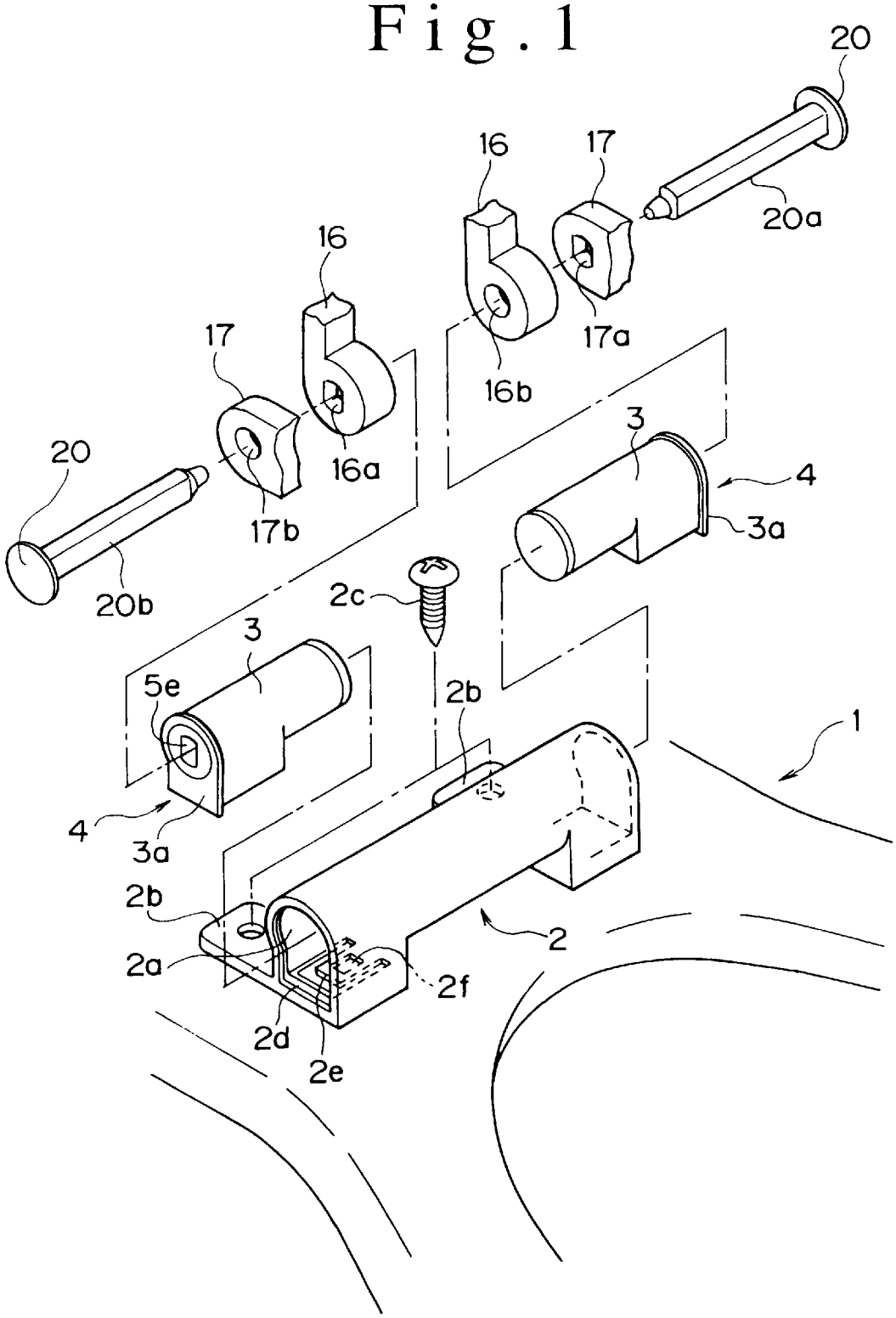
FIG. 1 is an exploded perspective view showing an example of fixtures for use to install the operating hinge of the present invention to a toilet bowl body.

Referring now to FIG. 1, a toilet bowl is illustrated, by way of example, of which a body is generally indicated with a reference numeral 1. For installation of the operating hinge according to the present invention to the toilet bowl body 1, there is provided on, and nearly at the center of, the rear top of the toilet bowl body 1 a cylindrical fixture 2 open at either axial end thereof (namely, it has a pair of fixing bores of which only one 2*a* is illustrated herein) and having two rearward projecting plates 2*b* (only one of which is illustrated herein) formed integrally with the cylinder 2. The cylinder 2 is to be secured to the body 1 of the toilet bowl with a pair of bolts 2*c* which are to be driven into the bowl body 1 through a pair of holes formed in the projecting plates 2*b,* respectively.

A pair of cylindrical hinge cases 3 form a pair of operators generally indicated with a reference numeral 4, right and left, respectively. The operators 4, or cylindrical hinge cases 3, are designed to be inserted into the bores 2*a,* respectively, of the cylinder 2, and removably fixed inside the cylinder 2. For this fixation of each hinge case 3 or operator 4 inside the cylinder 2, the hinge case 3 has a flange 3*a* formed integrally at one end thereof and an engagement projection 3*b* formed integrally on the lower side thereof, as shown in FIGS. 1 to 5. The flange 3*a* is designed to closely fit in an engagement indent 2*d* formed in an opening end portion, under the bore 2*a,* of the cylinder 2. The projection 3*b* is adapted for engagement in a hole 2*f* formed in an engagement piece 2*e* provided below the bore 2*a* of the cylinder 2. Thus, when the operator 4 or hinge case 3 is pressed into the bore 2*a* of the cylinder 2, the flange 3*a* and projection 3*b* will work in cooperation with the indent 2*d* and hole 2*f,* respectively, to securely fix the operator 4 inside the cylinder 2.

As seen in FIG. 1, the right and left operators 4 form one pair. The left operator 4 is destined to open and close the toilet seat, while the right one is for use with the seat lid. Since they are horizontally symmetrical with each other and identical in internal structure to each other, however, it should be noted that mainly the left operator 4 will be involved in the following description for the simplicity of the explanation. The operator 4 comprises a rotating shaft 5 of which the rotation is controlled by a first controller A and second controller B provided to the left of a partition wall 3*c* provided inside the hinge case 3 as will be best seen in FIGS. 3 to 5.

Figure 2:
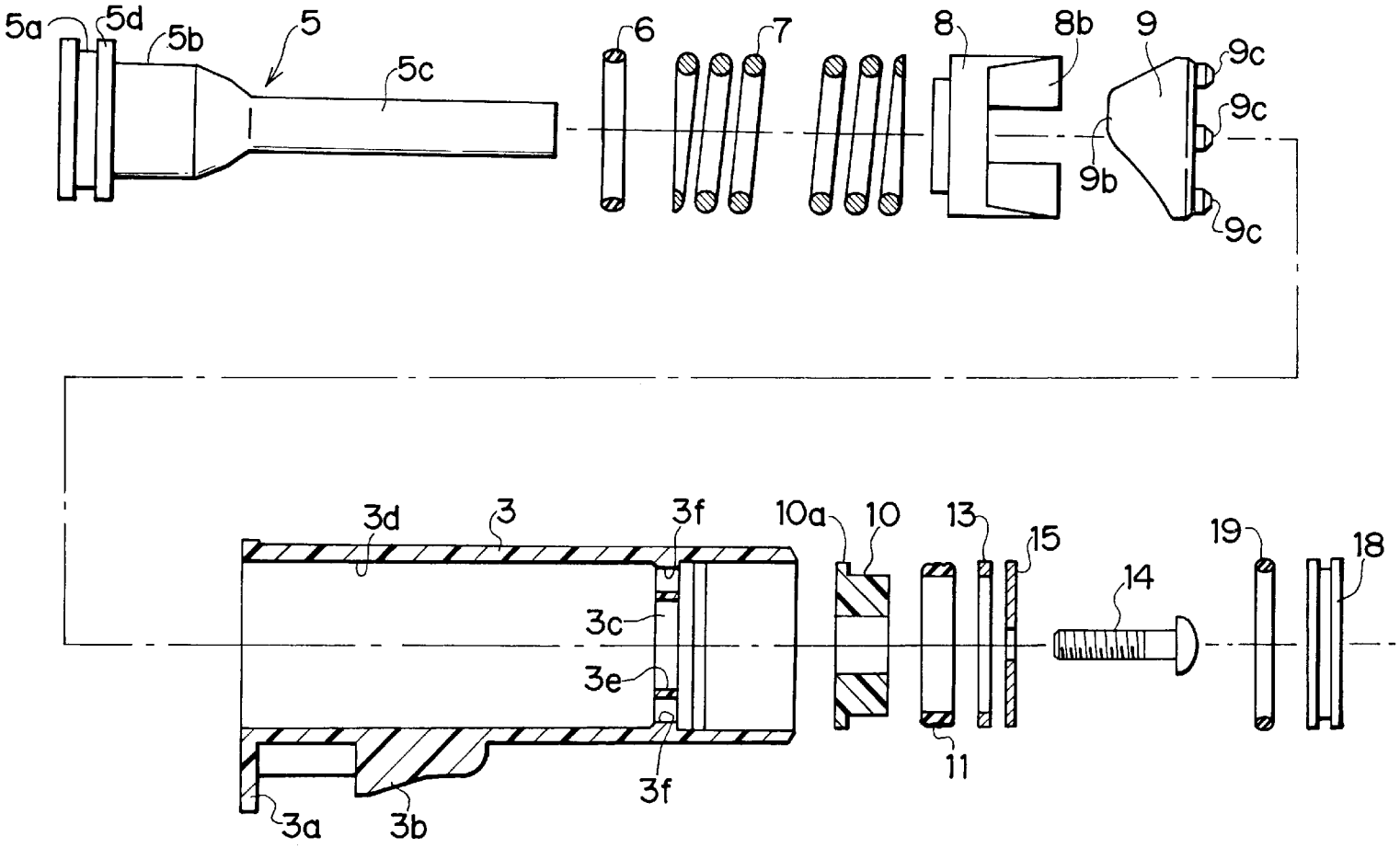
FIG. 2 is an exploded view, partially in axial-sectional form, of the operating hinge according to the present invention.
Figure 3:
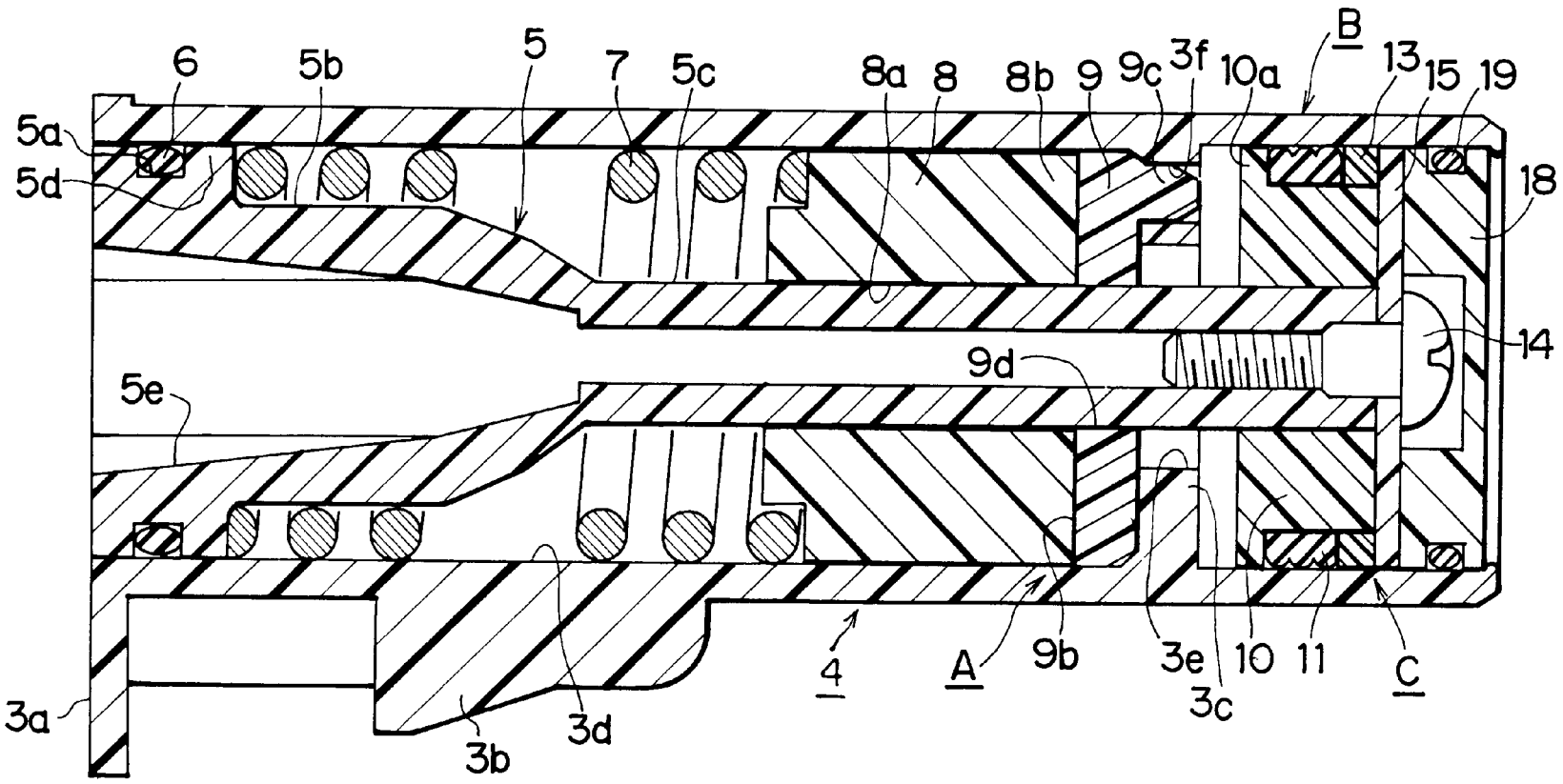
FIG. 3 is an axial-sectional view of the operating hinge of the present invention.
Figure 4:
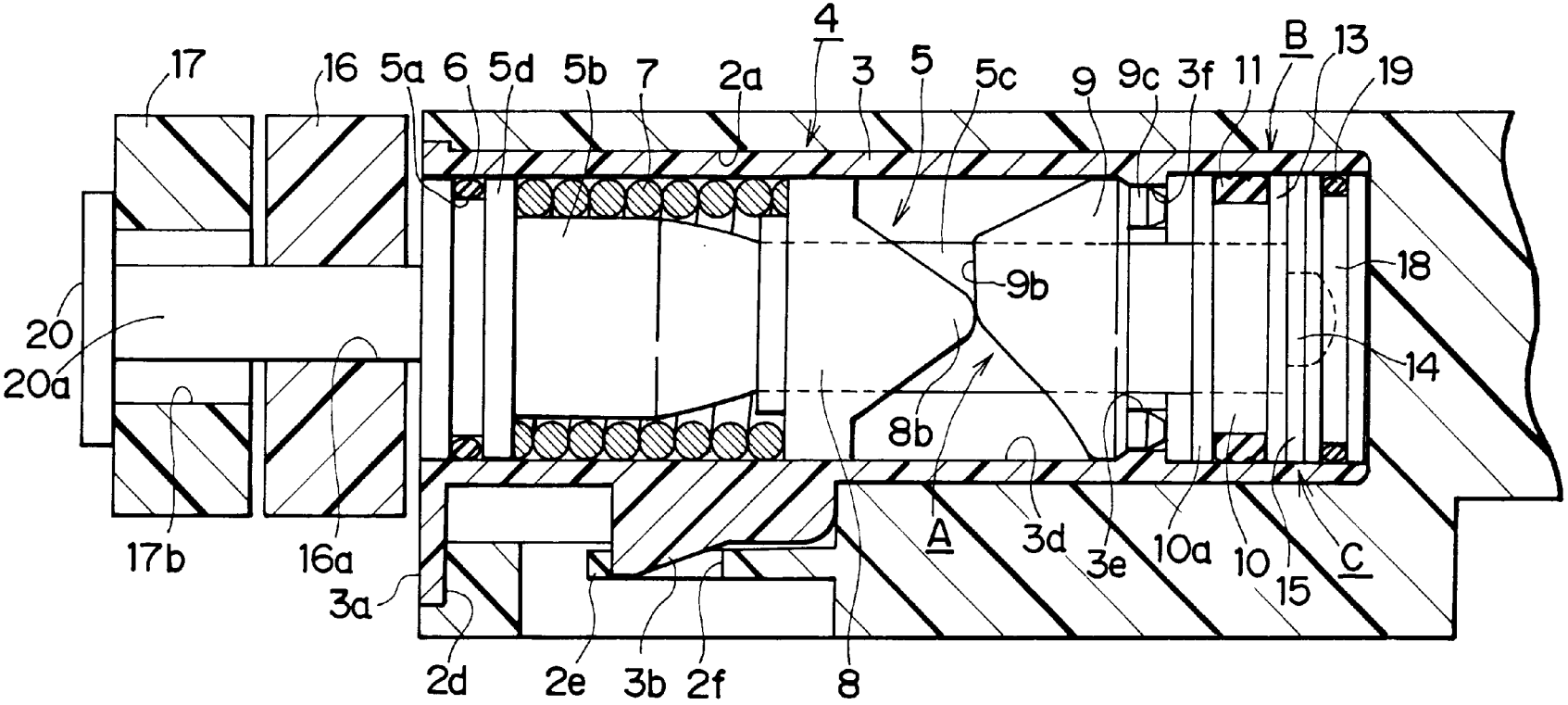
FIG. 4 is a drawing explaining the function of the operating hinge according to the present invention.
Figure 5:
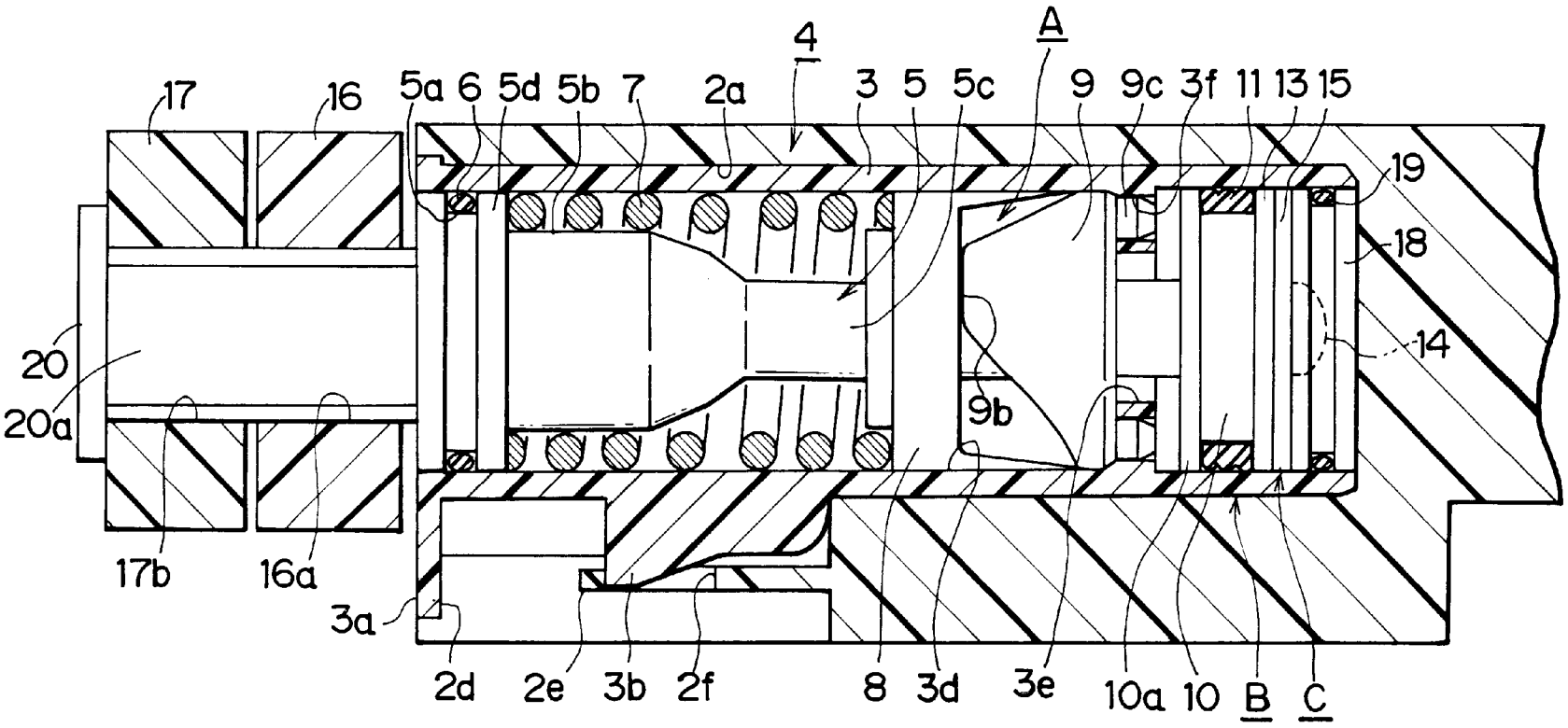
FIG. 5 is an axial-sectional view of the composite torque hinge, which is in a position when the seat has been opened to an angle of 90 from the position in FIG. 4.
Figure 8:
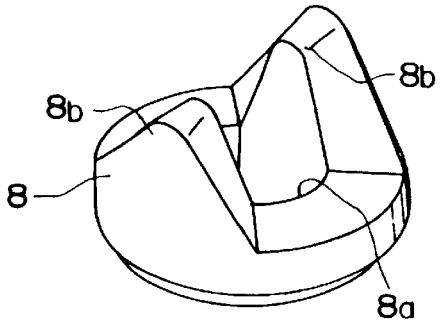
FIG. 8 is a perspective view of the rotatable sliding cam.
Figure 9:
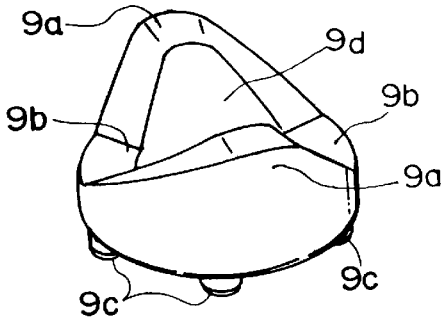
FIG. 9 is a perspective view of the stationary cam.

First, the first rotation controller A may be a cam mechanism, for example, which will be described herebelow. As will be evident from FIGS. 3 to 5, the hinge case 3 receives the rotating shaft 5 therein so that they are axially aligned with each other. Thus, the shaft 5 is rotatable about the axis thereof as well as of the shaft 5 itself. The rotating shaft 5 consists of, as counted from the left end thereof, of a base portion having an annular groove 5*a* formed circumferentially thereon and in which there is fitted a sealing member 6 such as an O-ring which will be put into contact with an inner circumferential wall 3*d* of the hinge case 3, a portion 5*b* of a large diameter on which a resilient member 7 such as a compression spring is wound, and a portion 5*c* having a reduced diameter and an elliptic cross-section and on which a rotatable cam 8 is slidably fitted. The rotating shaft 5 has also a flange 5*d* formed integrally on the large-diameter portion thereof as shown. The small-diameter portion 5*c* is born in a bearing hole 3*e* formed in the partition wall 3*c* and projecting inwardly and radially of the hinge case 3. The above-mentioned resilient member 7 is located between the flange 5*d* and rotatable sliding cam 8 to always urge the latter in one direction (rightward in the plane of the drawing). Also the rotatable sliding cam 8 has formed axially in the center thereof a hole 8*a* having a non-circular or generally elliptic section as shown in FIG. 8. With the small-diameter portion 5*c* fitted in this hole 8*a,* the cam 8 can be rotated together with the shaft 5. Also, the rotatable sliding cam 8 has formed in diametrical positions along the circumference thereof two projections 8*b* extending axially thereof as will be best seen from FIGS. 2 and 8. As shown in FIGS. 2 and 9, there is also provided a stationary cam 9 on one side of the partition wall 3*c* facing the open end of the hinge case 3. The stationary cam 9 is force-fitted in an engagement hole 3*f* formed in the partition wall 3*c* as shown in FIGS. 3 to 5. The cam 9 has formed in diametrical positions thereof, along the circumference thereof and on one side thereof a pair of crests 9*a* and a pair of troughs 9*b,* both extending axially of the cam 9 in one direction. Also the stationary cam 9 has formed on the other side thereof a plurality of projections 9*c* extending axially but in an opposite direction to that of the crests 9*a* and troughs 9*b*. The stationary cam 9 has a circular hole 9*d* formed axially in the center thereof. The small-diameter portion 5*c* of the rotating shaft 5 is fitted rotatably through this hole 9*d* of the stationary cam 9. Thus, when all are set inside the hinge case 3, the rotatable sliding cam 8 and stationary cam 9 are placed in a vis-vis relationship, and in contact, with each other, with the projections 8*b* of the cam 8 facing the crests 9*a* and troughs 9*b* of the cam 9.

Next, the second rotation controller B will be described herebelow. This controller B may be a damper, for example. As seen from FIGS. 3 to 5, a collar 10 with a flange 10*a* is fitted on an inner end portion of the small-diameter portion 5*c* of the rotating shaft 5, penetrated through and beyond the partition wall 3*c,* to be rotatable with the rotating shaft 5. A rubber ring 11 is fitted on the periphery of the collar 10 to abut the inner wall of the hinge case 3. A compression ring 13 is fitted on the remainder, next to the rubber ring 11, of the periphery of the collar 10. A screw 14 extending axially of the shaft 5 is provided as driven in the inner end of the small-diameter portion 5*c* of the rotating shaft 5 to retain at the inner end of the small-diameter portion 5*c* a washer 15 extending radially of the hinge case 5 and which will thus hold the compression ring 13. In this configuration, when the screw 14 is tightened or loosened, the rubber ring 11 can be urged axially of the hinge case 3 to adjust the pressure the rubber ring 11 applies to the inner wall of the hinge case 3. A viscous oil 12 such as grease or silicon oil, for example, is provided between the rubber ring 11 and the hinge case 3, as best seen from FIG. 6. The rubber ring 11 has a plurality of recesses 11*a* formed in the periphery thereof to receive and retain the viscous oil 12. Thus, the collar 10, compression ring 13, screw 14 and washer 15 form together a means C of adjusting the pressure of the rubber ring 11 to the inner wall of the hinge case 3.

Figure 6:
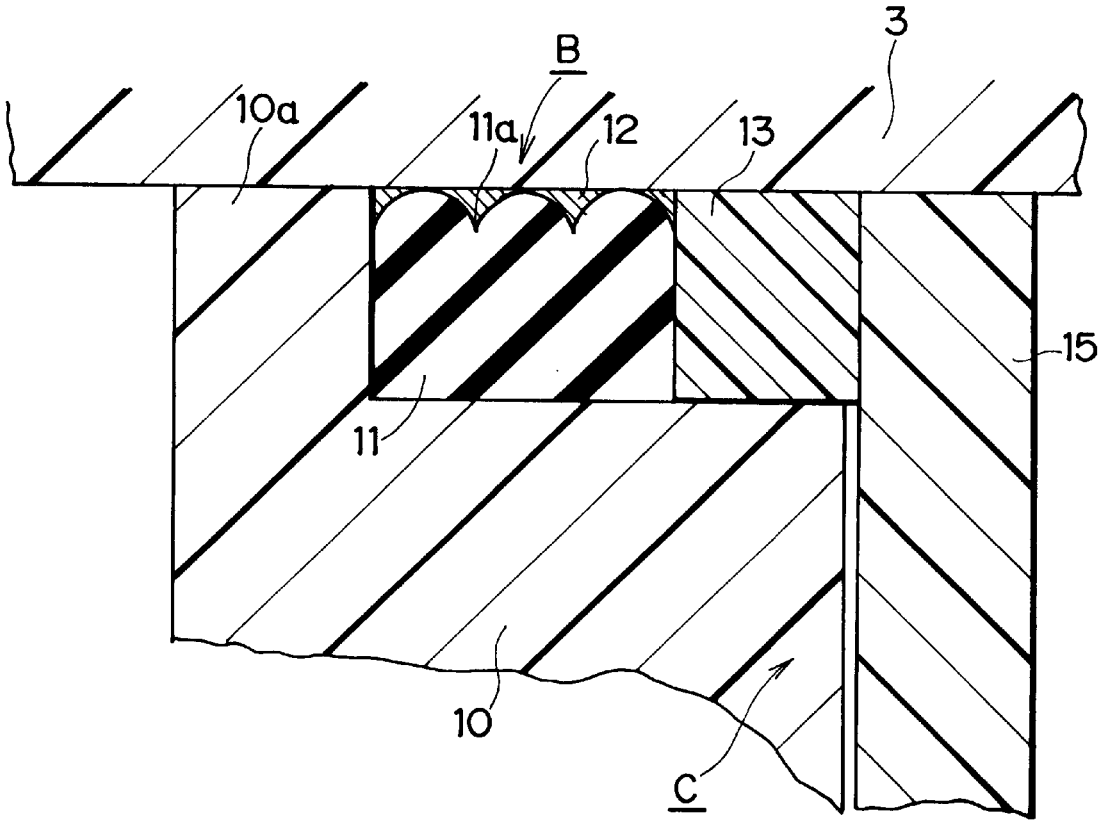
FIG. 6 is a fragmentary sectional view, enlarged in scale, of the damping member as a second rotation controller.
Figure 7:
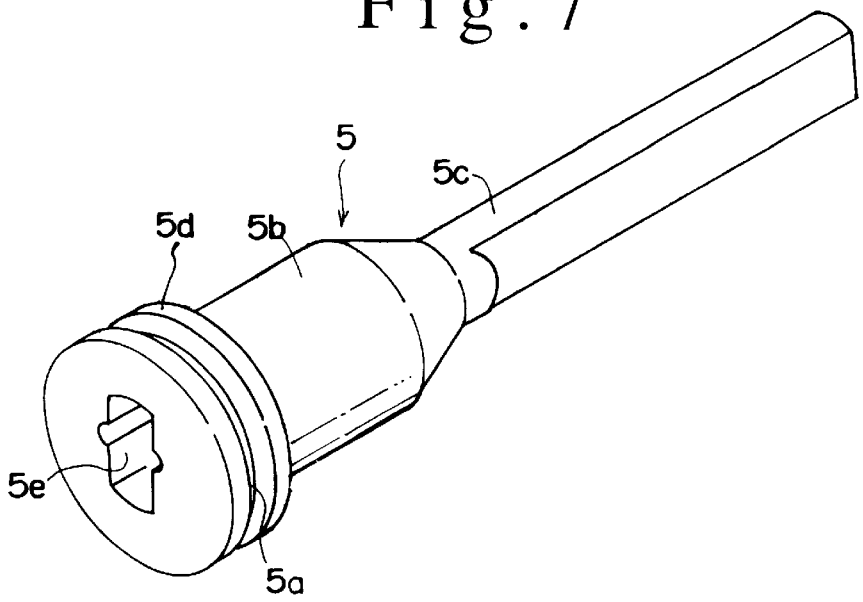
FIG. 7 is a perspective view of the rotating shaft.

As best seen from FIGS. 1, 5 and 6, the rotating shaft 5 has formed in the large-diameter portion thereof at an end portion thereof exposed out of the hinge case 3 a non-circular hole 5*e* extending axially inwardly of the end face of the shaft 5. The hole 5*e* has force-fitted therein a coupling pin 20 which supports a toilet seat base 16 and a seat lid base 17. The coupling pin 20 has a shaft portion 20*a* which has a non-circular or generally elliptic cross-section. The shaft portion 20*a* is first penetrated through a circular hole 17*b* formed in the lid base 17, then into a non-circular hole 16*a* formed in the seat base 16, and further into the hole 5*e* of the shaft 5. Namely, the lid base 17 is pivoted to the shaft portion 20*a*. Thus, the coupling pin 20 is rotatable with the seat base 16, and not with the lid base 17. The lid base 17, namely, the seat lid, is freely pivotable about the shaft portion 20*a* of the coupling pin 20. In effect, when the seat is opened or closed, this right-side rotation controller 4 allows the shaft 5 to be rotated about the coupling pin 20. On the contrary, when the seat lid is operated, it is just only supported on the pin shaft portion 20*a* and the shaft 5 will not be rotated correspondingly. In FIGS. 3–5, the reference numeral 18 indicates a plug which closes an end of the hinge case 3 opposite to the outer end, and 19 indicates a sealing member such as an O-ring, for example.

FIG. 1 also shows the right-side hinge case 3 or operator 4 in addition to the left-side hinge case 3 or operator 4 having been described above. The right-side hinge case 3 or operator 4 will be briefly described herebelow. As in the left-side operator 4, the coupling pin 20 has a shaft portion 20*a* having a non-circular cross-section. The shaft 15*a* is introduced in the non-circular hole 5*e* in the rotating shaft 5. However, the lid base 17 has formed therein a non-circular hole 17*a,* and the seat base 16 has a circular hole 16*b* formed therein. As mentioned above, the shaft portion 20*a* is to be first penetrated through the non-circular hole 17*a* in the lid base 17 and then into the circular hole 16*b* in the seat base 16. Thus, the seat base 16 is pivotable about the shaft portion 20*a* of the right-side coupling pin 20. Because of the non-circular hole 17*a* in the lid base 17, the coupling pin 20 is rotatable with the lid base 17. That is, when the seat is operated, its base 16 is just only supported on the coupling pin 20 and the shaft 5 will not be rotated correspondingly. Therefore, the left-side operator 4 is destined for controlling the rotation of the toilet seat while the right-side one is for use with the seat lid.

Figure 12:
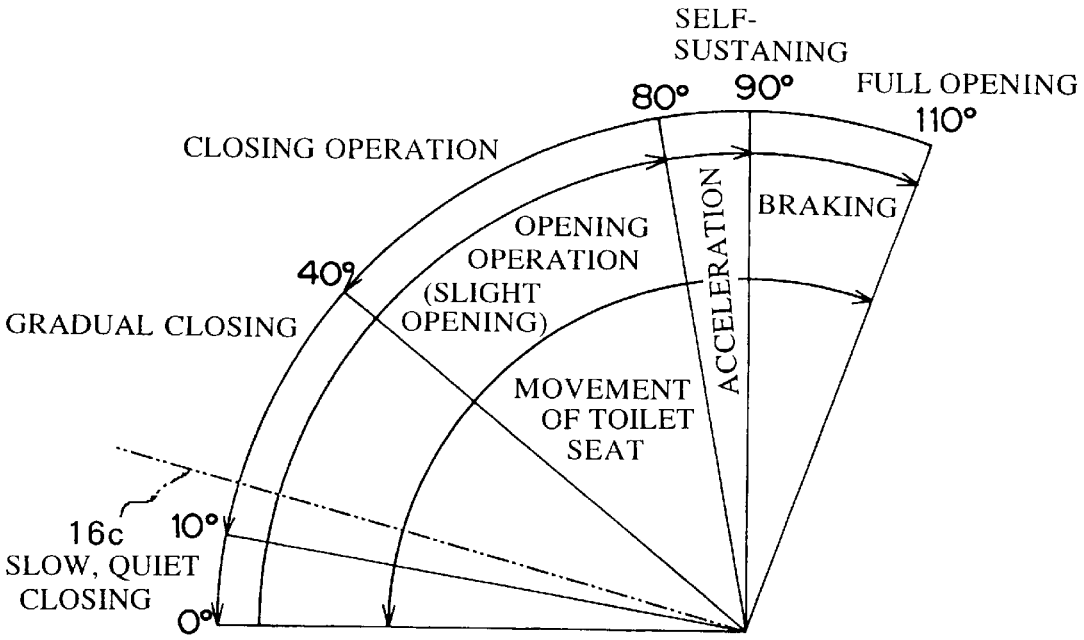
FIG. 12 is a functional diagram of the operating hinge according to the present invention.

The operating hinge according to the present invention functions as will be described herebelow:

Referring now to FIG. 12 showing a functional diagram of the operating hinge, an imaginary line 16*c* indicates the toilet seat. With the seat 16*c* in closed position, the rotatable sliding cam 8 of the cam mechanism in the first rotation controller A shown in FIG. 5 is in direct contact, at the projections 8*b* thereof, with the crests 9*a* of the stationary cam 9, and the resilient member 7 is fully compressed. On the other hand, the rubber ring 11 as a damping member in the second rotation controller B is in slight contact with the inner wall of the hinge case 3. When the toilet seat 16*c* is opened from this position, the rotating shaft 5 will be rotated against the action of the damping member by means of the coupling pin 20 by which the seat base 16 is connected to the rotating shaft 5, and the projections 8*b* of the rotatable sliding cam 8 rotating in a same direction as the shaft 5 will slide in the direction of the stationary cam 9 while going down from the crest 9*a* into the trough 9*b*.

Figure 10:
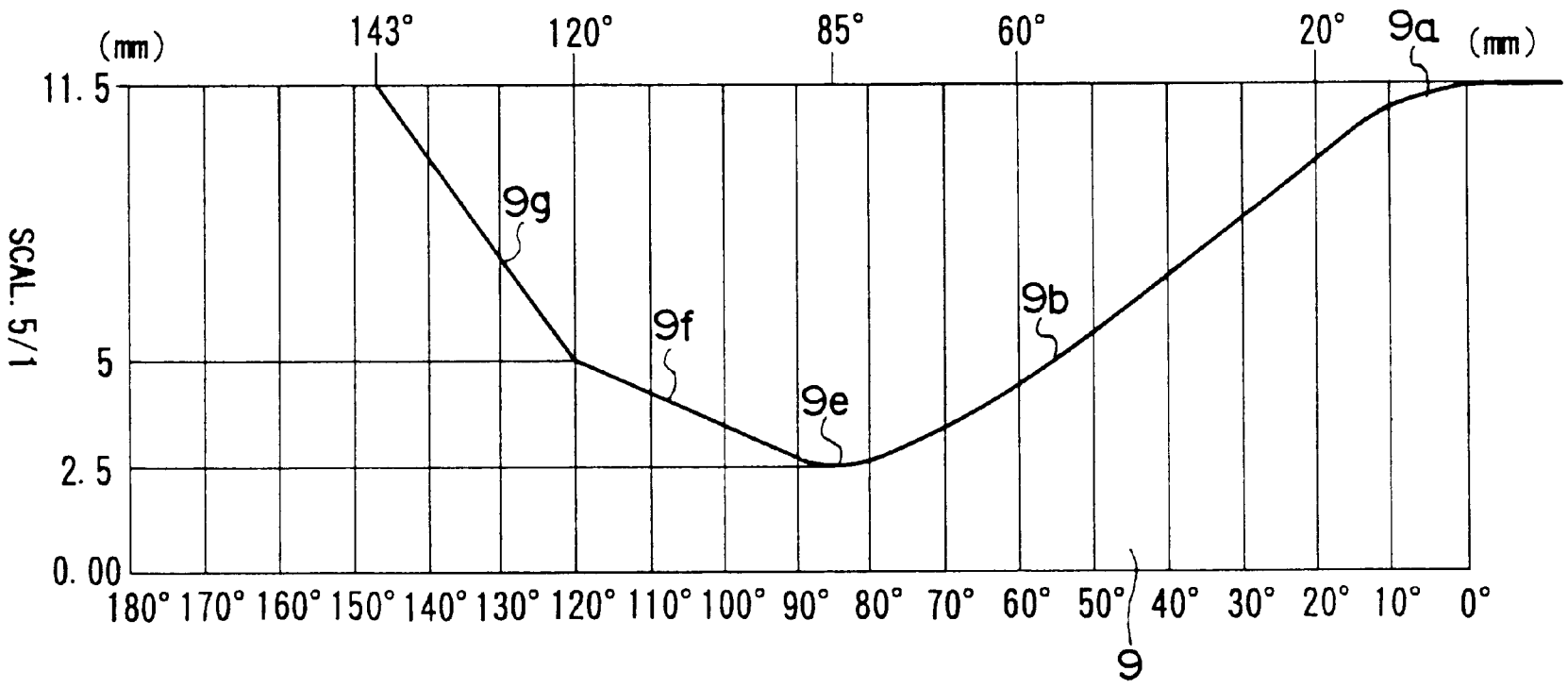
FIG. 10 is a development for explanation of the stationary cam shape.
Figure 11:
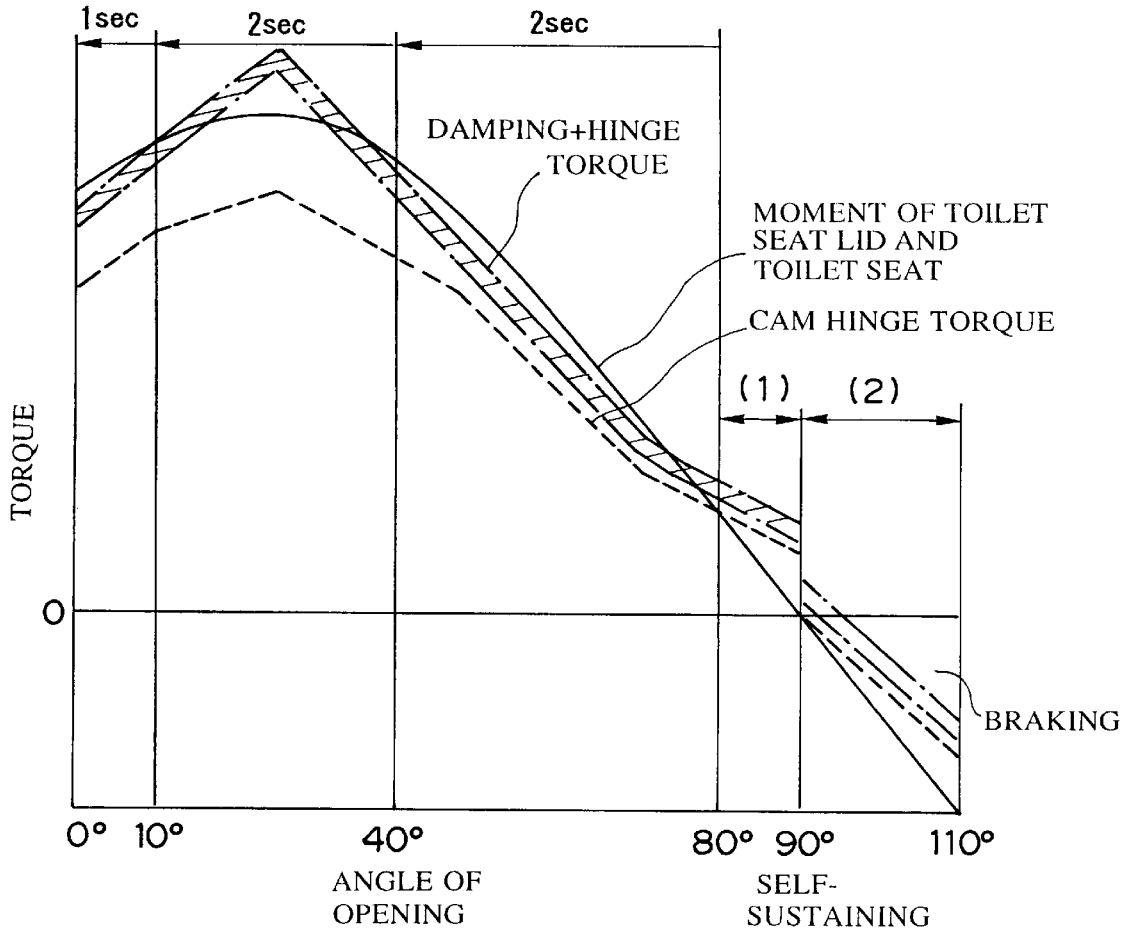
FIG. 11 is a torque curve of the operating hinge according to the present invention.

Thus, the rotating shaft 5 is allowed to smoothly rotate to open the seat 16*c*. It should be noted that as shown in FIG. 10, each trough 9*b* of the stationary cam 9 of the cam mechanism is followed by a small deeper trough 9*e* followed by a gentle ascending slope 9*f* which is further followed by a steeper ascending slope 9*g* as shown in FIG. 10. By starting to reduce the cam torque at the opened angle of 80 and reducing the cam torque down to zero at a position short of an opened angle of 90 as shown in FIGS. 11 and 12, the seat 16*c* can be urged in a further opening direction to a position where it will be able to stand by itself. Thereafter, when the cam torque is increased again to brake the seat 16*c* toward a full opened angle of 110, a bounding or rebounding of the seat 16*c* is absorbed. Thus, the operating hinge according to the present invention allows to elaborately fit the movement of the seat 16*c* as necessary to the angular moment and to appropriately control the movement of the seat 16*c* in each of the operating steps.

When closing the seat 16*c* once opened, the cam mechanism of the first rotation controller A will reversely follow the above opening procedure. In this case, however, the projections 8*b* of the rotatable sliding cam 8 will start moving at an opened angle of about 40 and slide on the stationary cam 9 from the trough 9*b* of the cam 9 to the crest 9*a* against the resilience of the member 7 as shown in FIGS. 11 and 12. At this time, a resistance will take place to cause a reverse torque which will cancel the angular moment of the seat 16*c,* thereby preventing the seat 16*c* from being abruptly closed. On the other hand, the rubber ring 11 as a damping member in the second rotation controller B, abutting the inner wall of the hinge case 3, and the viscosity of the oil 12 applied between the rubber ring 11 and the hinge case 3, will provide a damping action under which the torque is controlled, whereby the seat 16*c* can be closed softly even when the seat 16*c* is released by taking off the hand from it. It should be noted that when as the screw 14 is tightened, the compression ring 13 is slid axially of the collar 10 to compress the rubber ring 11. By increasing the pressure of the rubber ring 11 to the inner wall of the hinge case 3, the rotating torque of the rotating shaft 5 can be adjusted.

As having been described above, when closing the seat 16*c,* the reverse torque of the cam mechanism of the first rotation controller A and the damping action of the damping member in the second rotation controller B, will effectively allow the seat 16*c* to be closed calmly or gently, not abruptly.

With the operating hinge according to the present invention, when the seat 16*c* is closed to an angle of 80 and then released with some force applied thereto, it will be closed to an angle of about 40 at a relatively high speed under a weak cam torque and damping action. This operation will take about 2 sec as seen from FIGS. 11 and 12. Thereafter, the projections 8*b* of the rotatable sliding cam 8 of the cam mechanism will climb the ascending slopes of the troughs 9*b* toward the crests 9*a* of the cam 9 against the resilience of the member 7. Therefore, the seat 16*c* will be closed slowly to an angle of about 10, and then more slowly to an angle of 0. A time of about 5 sec is required for this full closing of the seat 16*c*.

Thus, a composite torque action, derived from the cam torque created by the cam mechanism and the damping action of the damping member, permits to adjust the operating time of the seat 16*c* being opened or closed and elaborately control the movement of the seat 16*c* in each of the operating steps for the user to be noticed of the timely seat operations.

In the foregoing, mainly the left-side operator 4 for the seat 16*c* has been described as to the function thereof. The right-side operator 4 is used to open and close the seat lid from a closed position. However, since the seat lid is not frequently operated in comparison with the seat 16*c,* it is not so much required to elaborately control the movement of the seat lid for the user to be noticed of the seat lid operations. Therefore, for the seat lid operator, the stationary cam may be designed to have crests and troughs of more simplified shapes than those of the stationary cam in the seat operator. Since an angular moment taking place in this seat lid operator is basically the same as a one in the seat operator, however, the stationary cam in the seat lid operator may be of a same structure as that in the seat operator except for the shape of the crests and troughs. No further description will be made of the operator 4 for the seat lid.

What is claimed is:

1. An operating hinge for a seat and seat lid of a toilet bowl, comprising:

a hinge case to be installed to a body of a toilet bowl;

a shaft provided rotatably inside the hinge case to support the seat and seat lid;

a stationary cam secured inside the hinge case and having formed therein a central hole through which the rotating shaft is axially penetrated;

a cam provided inside the hinge case in a vis-vis relationship with the stationary cam and having formed therein a central hole through which the rotating shaft is axially penetrated, to be slidable on, and rotatable with, the rotating shaft; and a resilient member for urging the rotatable sliding cam toward the stationary cam;

further comprising, to more positively control the rotation of the rotating shaft:

a rubber ring fitted on the rotating shaft between the rotating shaft and the hinge case to abut the inner wall of the hinge case;

a viscous oil applied between the periphery of the rubber ring and the hinge case inner wall the rubber ring abuts; and a means of adjusting a pressure the rubber ring applies to the inner wall of the hinge case.

2. The operating hinge according to claim 1, wherein the means of adjusting the pressure applied by the rubber ring comprises a flanged collar fitted on, and rotatably with, a small-diameter portion of the rotating shaft penetrated through a partition wall formed integrally in the hinge case, a rubber ring fitted on the periphery of the collar, a compression ring fitted axially slidably on the periphery of the collar to abut the rubber ring, a washer and a screw urging the compression ring axially.

3. An operating hinge for a seat and seat lid of a toilet bowl, including:

a hinge case to be installed to a body of a toilet bowl;

a shaft provided rotatably inside the hinge case to support the seat and seat lid;

a stationary cam secured inside the hinge case and having formed therein a central hole through which the rotating shaft is axially penetrated;

a cam provided inside the hinge case in a vis-vis relationship with the stationary cam and having formed therein a central hole through which the rotating shaft is axially penetrated, to be slidable on, and rotatable with, the rotating shaft; and a resilient member for urging the rotatable sliding cam toward the stationary cam;

further comprising, to more positively control the rotation of the rotating shaft:

a rubber ring fitted on the rotating shaft between the rotating shaft and the hinge case to abut the inner wall of the hinge case;

a viscous oil applied between the outer periphery of the rubber ring and the inner wall of the hinge case to which the rubber ring is force-fitted;

a means of adjusting a pressure the rubber ring applies to the inner wall of the hinge case; and a recess formed in the outer periphery of the rubber ring to receive and retain the viscous oil therein.

4. An operating hinge for a seat and seat lid of a toilet bowl, including:

a hinge case to be installed to a body of a toilet bowl;

a shaft provided rotatably inside the hinge case to support the seat and seat lid;

a stationary cam secured inside the hinge case and having formed therein a central hole through which the rotating shaft is axially penetrated;

a cam provided inside the hinge case in a vis-vis relationship with the stationary cam and having formed therein a central hole through which the rotating shaft is axially penetrated, to be slidable on, and rotatable with, the rotating shaft; and a resilient member for urging the rotatable sliding cam toward the stationary cam;

further comprising, to more positively control the rotation of the rotating shaft:

a rubber ring fitted on the rotating shaft between the rotating shaft and the hinge case to abut the inner wall of the hinge case;

a viscous oil being applied between the periphery of the rubber ring and the hinge case inner wall the rubber ring abuts;

a means of adjusting a pressure the rubber ring applies to the inner wall of the hinge case, the means comprising a flanged collar fitted on, and rotatably with, a small-diameter portion of the rotating shaft penetrated through a partition wall formed integrally in the hinge case, a rubber ring fitted on the periphery of the collar, a compression ring fitted axially slidably on the periphery of the collar to abut the rubber ring, a washer and a screw urging the compression ring axially; and a recess formed in the periphery of the rubber ring to receive and retain the viscous oil therein.

* * * * *